US006750837B1

(12) United States Patent
Kondoh

(10) Patent No.: US 6,750,837 B1
(45) Date of Patent: Jun. 15, 2004

(54) FERROELECTRIC LIQUID CRYSTAL DISPLAY

(75) Inventor: Shinya Kondoh, Nishitokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 63 days.

(21) Appl. No.: 09/807,033

(22) PCT Filed: Aug. 10, 2000

(86) PCT No.: PCT/JP00/05381

§ 371 (c)(1),
(2), (4) Date: Apr. 9, 2001

(87) PCT Pub. No.: WO01/13167

PCT Pub. Date: Feb. 22, 2001

(30) Foreign Application Priority Data

Aug. 10, 1999 (JP) ..... 11-226709

(51) Int. Cl.[7] ..... G09G 3/36
(52) U.S. Cl. ..... 345/97
(58) Field of Search ..... 345/97, 98, 102, 345/137, 174, 94, 96

(56) References Cited

U.S. PATENT DOCUMENTS

| | | | | |
|---|---|---|---|---|
| 5,534,884 | A | | 7/1996 | Mase et al. |
| 5,838,293 | A | * | 11/1998 | Kondoh ..... 345/97 |
| 5,990,859 | A | * | 11/1999 | Inoue et al. ..... 345/103 |
| 2002/0158831 | A1 | * | 10/2002 | Kondoh ..... 345/97 |

FOREIGN PATENT DOCUMENTS

| | | |
|---|---|---|
| EP | 0 526 097 A2 | 2/1993 |
| EP | 572143 A1 | 12/1993 |
| EP | 573174 A1 | 12/1993 |
| JP | 4-249290 | 9/1992 |
| JP | 9-80388 | 3/1997 |
| JP | 9-222593 | 8/1997 |
| JP | 10-123486 | 5/1998 |
| JP | 10-253943 | 9/1998 |
| JP | 10-253944 | 9/1998 |
| JP | 10-307284 | 11/1998 |
| JP | 11-119189 | 4/1999 |
| JP | 11-174415 | 7/1999 |

* cited by examiner

*Primary Examiner*—Amare Mengistu
(74) *Attorney, Agent, or Firm*—Finnegan, Henderson, Farabow, Garrett & Dunner, L.L.P.

(57) ABSTRACT

The invention relates to a ferroelectric liquid crystal display in which the trailing phenomenon is eliminated by providing an optimum reset period. The ferroelectric liquid crystal display has a reset period for resetting the ferroelectric liquid crystal to a black display state before starting the scanning period, and includes a mechanism for adjusting the length of the reset period in accordance with the display data, thus setting an optimum reset period corresponding to the display data. The reset period is provided for each pixel. Also, the reset period can be provided at the same timing so that all the pixels may be reset at the same time. The ferroelectric liquid crystal panel includes a backlight, which is turned off during the reset period and turned on during the remaining period. A mechanism is provided for adjusting the brightness of the backlight in accordance with the length of the reset period.

8 Claims, 9 Drawing Sheets

FERROELECTRIC LIQUID CRYSTAL DISPLAY

TECHNICAL FIELD

The present invention relates to a ferroelectric liquid crystal display such as a liquid crystal display panel or a liquid crystal light shutter array having a liquid crystal layer of ferroelectric liquid crystal.

BACKGROUND ART

Generally, ferroelectric liquid crystal molecules are known to move along the side surface of a cone (hereinafter referred to as "the liquid crystal cone") with the change of an external object such as the electric field. In the case where the ferroelectric liquid crystal is held between a pair of substrates and used as a liquid crystal panel, the ferroelectric liquid crystal is controlled in such a manner that the ferroelectric liquid crystal molecules are located at one of the two places on the side surface of the liquid crystal cone. The stable state in which the liquid crystal molecules are located at one of the two places is called a first ferroelectric state or a second ferroelectric state, as the case may be.

FIG. 1 is a diagram showing an example of the configuration of a ferroelectric liquid crystal panel when the ferroelectric liquid crystal is used as a display. A liquid crystal cell 2 is arranged between polarization plates 1*a*, 1*b* conforming to a crossed Nicol in such a manner that either the polarization axis a of the polarization plate 1*a* or the polarization axis b of the polarization plate 1*b* is parallel to the direction along the long axis of the molecules in the first ferroelectric state or the second ferroelectric state when a voltage is not applied. In the case of FIG. 1, the direction along the long axis of the molecules in the second ferroelectric state coincides with the polarization axis a.

In the case where the polarization plate is arranged as shown in FIG. 1, the light is not transmitted and black is displayed, on the ferroelectric liquid crystal panel, when the ferroelectric liquid crystal is in the ferroelectric state in which the direction along the long axis of the molecules coincides with the direction along the polarization axis of the polarization plate. With the configuration shown in FIG. 1, the light is not transmitted and black is displayed (non-transmission state), on the ferroelectric liquid crystal panel, when the ferroelectric liquid crystal is in the second ferroelectric state.

With the change in polarity of the applied voltage, on the other hand, the ferroelectric liquid crystal comes to assume a ferroelectric state with the direction along the long axis of the molecules thereof failing to coincide with the direction along the polarization axis of the polarization plate. In such a case, the molecules of the ferroelectric liquid crystal are slanted at an angle to the polarization axis, and therefore the light from the backlight is transmitted and white is displayed (transmission state).

In FIG. 1, the direction along the long axis of the molecules when the ferroelectric liquid crystal is in the second ferroelectric state is rendered to coincide with the direction along the polarization axis of the polarization plate. On the other hand, the direction along the long axis of the molecules when the ferroelectric liquid crystal is in the first ferroelectric state can be rendered to coincide with the direction along the polarization axis of the polarization plate. In such a case, black can be displayed (non-transmission state) when the ferroelectric liquid crystal is in the first ferroelectric state, and white can be displayed (transmission state) when the ferroelectric liquid crystal is in the second ferroelectric state.

The present invention is applicable to either panel configuration. In the following description, the case where the panel configuration shown in FIG. 1 is employed will be explained.

When a voltage is applied to this ferroelectric liquid crystal panel, the change of the light transmittance plotted as a graph follows a loop as shown in FIG. 2.

The switching of the ferroelectric-liquid crystal, i.e. the transition from one ferroelectric state to the other ferroelectric state occurs only in the case where a voltage with the value of the product of the wave width value and the wave height value, which is not less than the a threshold value, is applied to the ferroelectric liquid crystal molecules. As shown in FIG. 2, either the first ferroelectric state (transmission, white display) or the second ferroelectric state (non-transmission, black display) is selected according to the difference in polarity of the applied voltage.

The voltage value at which the light transmittance begins to change, when the voltage is applied and increased, is denoted by V1, the voltage value at which the change of the light transmittance is saturated is denoted by V2, on the other hand, when the voltage is decreased and further the voltage of opposite polarity is applied, the voltage value at which the light transmittance begins to decrease is denoted by V3, and the voltage value at which the change of the light transmittance is saturated is denoted by V4.

As shown in FIG. 2, in the case where the value of the voltage applied is not less than the threshold value of the ferroelectric liquid crystal molecules, the first ferroelectric state (transmission, white display) is selected. In the case where a voltage of opposite polarity not less than the threshold value of the ferroelectric liquid crystal molecules is applied, on the other hand, the second ferroelectric state (non-transmission, black display) is selected.

A typical driving waveform of a ferroelectric liquid crystal display using a ferroelectric liquid crystal panel with the polarization plate arranged as shown in FIG. 1 is shown in FIG. 3. In the drawing, (a) designates a scanning voltage waveform (b) a signal voltage waveform, (c) a combined voltage waveform, and (d) a light transmittance.

A time division driving method is known as a method of driving a ferroelectric liquid crystal display. In the time division driving method, a plurality of scanning electrodes and signal electrodes are formed on a substrate and a voltage is applied to each electrode to drive a liquid crystal element.

As shown in FIG. 3, the writing operation is performed by applying a scanning voltage (a) to the scanning electrodes, a signal voltage (b) to the signal electrodes and a combined voltage (c) to the pixels of the liquid crystal panel. FIG. 3 shows driving waveforms of two frames, in which ON indicates the white display and OFF the black display. The driving waveforms shown in FIG. 3 have one scanning period for carrying out the display based on one display data. One scanning period has therein a selection period (Se) for selecting the display state and a non-selection period (NSe) for holding the selected display state, and a reset period (Rs) is provided before the start of the selection period (Se).

To write the next display, the ferroelectric liquid crystal is reset to one ferroelectric state in the reset period (Rs) regardless of the immediately preceding display state. In the case of FIG. 3, in the first half of the reset period (RS), the ferroelectric liquid crystal is reset to the first ferroelectric state in which the liquid crystal is white display (transmission state) and, in the last half, is reset to the second ferroelectric state in which the liquid crystal is black display (non-transmission state). In this method of driving the ferroelectric liquid crystal display, it is common to provide a reset period for applying a pulse of a different polarity regardless of the immediately preceding display state in order to assure a satisfactory display.

Conventionally, in the case where an image with a rapidly changing screen is displayed on a liquid crystal display unit using an ordinary liquid crystal such as nematic one, a phenomenon has occurred in which an image accurately following the screen change cannot be displayed. In a typical case where an image of a ball moving about in a game is displayed on a liquid crystal display unit, a phenomenon may occur in which the contour of the ball cannot be displayed accurately but displayed blurred (hereafter, this phenomenon is referred to as the "trailing phenomenon"). Conventionally, this trailing phenomenon was considered to occur due to the slow switching of the liquid crystal molecules. In recent years, however, it has been reported that this phenomenon occurs not only for the slow switching of the liquid crystal molecules, but also for the conventional driving method of the liquid crystal. The reason is that, in the scanning period in which the display is written in the pixels based on the display data, when writing the next display in the pixels without reset the display preceding the writing, the preceding display is left as a persisting image in the human eyes viewing the display, thereby causing the trailing phenomenon.

The ferroelectric liquid crystal has so far been considered to cause the trailing phenomenon not easily due to its rapid switching characteristic as compared with an ordinary liquid crystal. The recent research efforts have revealed, however, that in addition to the rapid switching characteristic, the driving method unique to the ferroelectric liquid crystal, i.e. the provision of a reset period described above is another contributing factor for a reduced trailing phenomenon.

Nevertheless, the past research efforts have not clarified the manner in which the ferroelectric liquid crystal is to be controlled most effectively during the reset period to reduce the trailing phenomenon. Further, the problem still remains unsolved that the mere provision of a reset period cannot completely eliminate the trailing phenomenon in the animation display in which display data changes at high speed successively.

In view of this, the object of the present invention is to provide a ferroelectric liquid crystal display using a ferroelectric liquid crystal having a superior display quality, in which an optimum reset period is provided for displaying an animation or a still image.

DISCLOSURE OF THE INVENTION

In order to achieve the above-mentioned object, a ferroelectric liquid crystal display according to this invention is characterized in that at least one scanning period is set for executing the display based on one display data, a reset period is provided for resetting the ferroelectric liquid crystal to the black display state before starting the scanning period, and the length of the reset period is adjusted in accordance with the display data, thereby providing an optimum reset period corresponding to the display data.

In this invention, the reset period is provided for each pixel. Also, the reset periods can be provided at the same timing to reset all the pixels at the same time.

The ferroelectric liquid crystal panel has a backlight, which is turned off during the reset period and turned on during the remaining period. The ferroelectric liquid crystal panel also has a mechanism for adjusting the brightness of the backlight in accordance with the length of the reset period.

In the reset period, the ferroelectric liquid crystal has a first ferroelectric state and a second ferroelectric state, and the scanning period has a selection period (Se) for selecting a display state and a non-selection period (NSe) for holding the selected display state.

The mechanism for adjusting the length of the reset period is a control device for adjusting the reset period and can be adjusted manually while watching the screen. The mechanism for adjusting the length of the reset period, on the other hand, has a plurality of display data memories for continuously storing the display data, or sequentially storing the display data at intervals of a plurality of blocks into which the display data are divided, and a display data comparison circuit for comparing the display data in the display data memories with each other and outputting the result of comparison, i.e. the change amount of the display data. The reset period can thus be automatically adjusted according to this output.

EFFECTS OF THE INVENTION

With the ferroelectric liquid crystal display according to this invention, a reset period is provided in which black is displayed regardless of the display state of the ferroelectric liquid crystal, and the length of the reset period is adjusted according to the change amount of display data, i.e. whether an animation or a still image is involved, thereby making it possible to produce a superior display quality free of the trailing phenomenon. Also, the brightness of the backlight is adjusted in accordance with the length of the reset period. Therefore, a satisfactory display can be obtained by maintaining a certain brightness, both in the case of a display slow in motion such as a still image and in the case of a display rapid in motion such as a game.

The ferroelectric liquid crystal display according to the invention, which is described as an invention for display, can be used as a liquid crystal shutter. In such a case, the driving waveforms described as related to an animation and a still image correspond to the driving waveforms for high shutter speed and low shutter speed, respectively. By using these driving waveforms, therefore, the present invention can be applied to the liquid crystal shutter.

DETAILED DESCRIPTION OF THE INVENTION

The present inventor has studied the manner in which the ferroelectric liquid crystal is to be controlled during the reset period most effectively. As a result, it has been found that the trailing phenomenon is reduced by changing the pixels to black display when the display data is switched, i.e. before a given display in the pixels is followed by the next display. Specifically, it is necessary to provide a reset period and display black (non-transmission state) before starting the scanning period as described above. It has been confirmed, on the other hand, that the effect of reducing the trailing phenomenon is not substantially produced in the case where white is displayed during a reset period.

Figure 3:
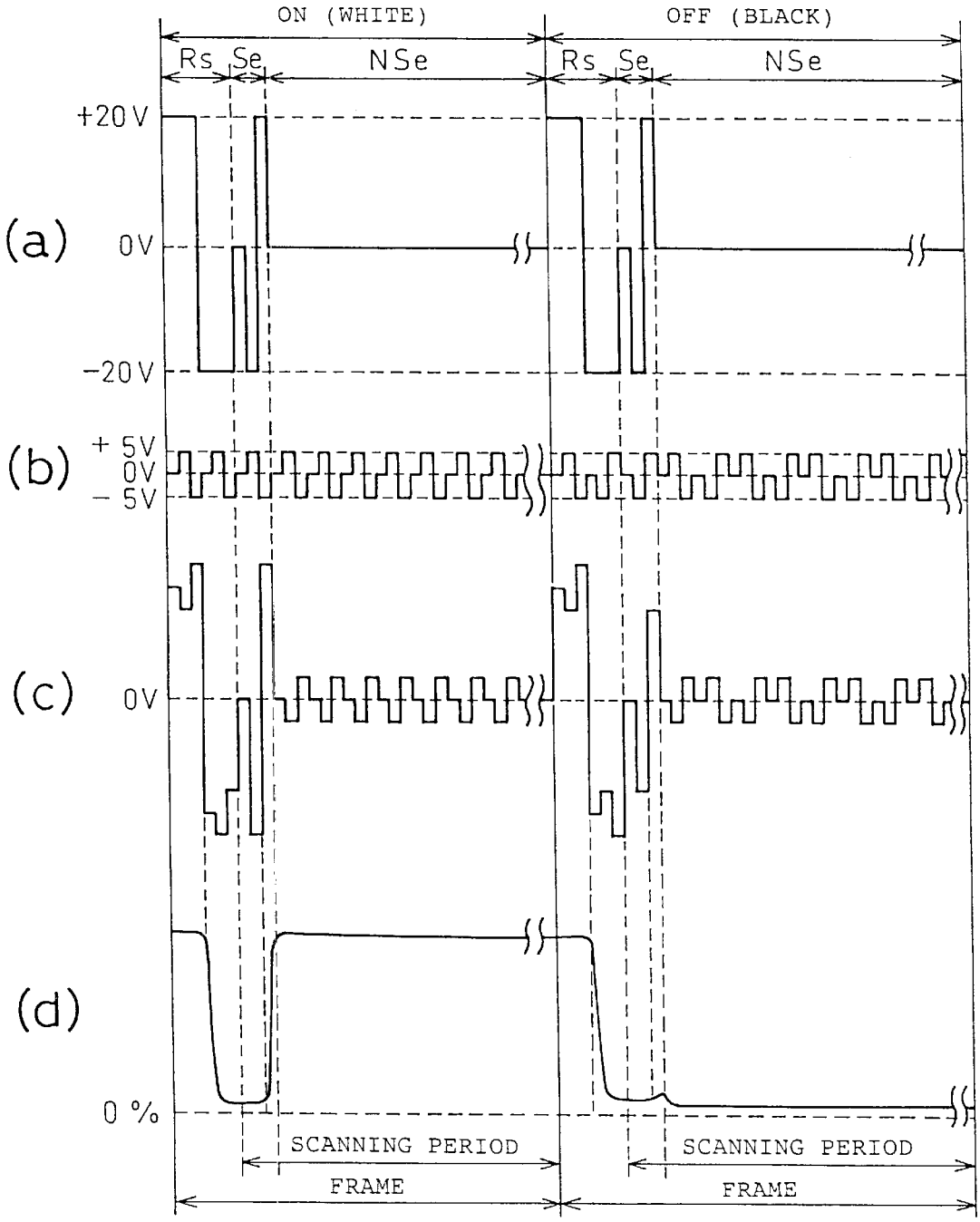
FIG. 3 is a diagram showing driving waveforms of a ferroelectric liquid crystal display usable in the invention.

As indicated in the reset period (Rs) of FIG. 3, it is common to set the liquid crystal of the ferroelectric liquid crystal display to both the first and second ferroelectric states during the reset period. In the case of the driving waveforms shown in FIG. 3, a voltage higher than a positive threshold value is applied in the first half of the reset period (Rs) and the ferroelectric liquid crystal becomes the first ferroelectric state in which white is displayed (transmission state). In the last half of the reset period (Rs), on the other hand, a voltage higher than a negative threshold value is applied and becomes the second ferroelectric state in which black is displayed (non-transmission state). In this way, both positive and negative voltages are applied during the reset period for producing an alternating current. Also in the conventional driving method shown in FIG. 3, black is always displayed (non-transmission state) during the reset period, and therefore the trailing phenomenon can be reduced as compared with the driving method lacking the reset period.

In this connection, it has been found that the trailing phenomenon can be more effectively reduced by setting a long reset period and a sufficient long period of black display. Especially in the case of an image of which display is switched rapidly such as an animation used in a game, the trailing phenomenon appears significantly. In such a case, the trailing phenomenon is reduced and a more desirable result is obtained by setting a long period of black display by lengthening the reset period. Conversely, in the case of an image such as a still image which is switched slowly, the trailing phenomenon can be sufficiently eliminated even by shortening the reset period for short black display.

Figure 4:
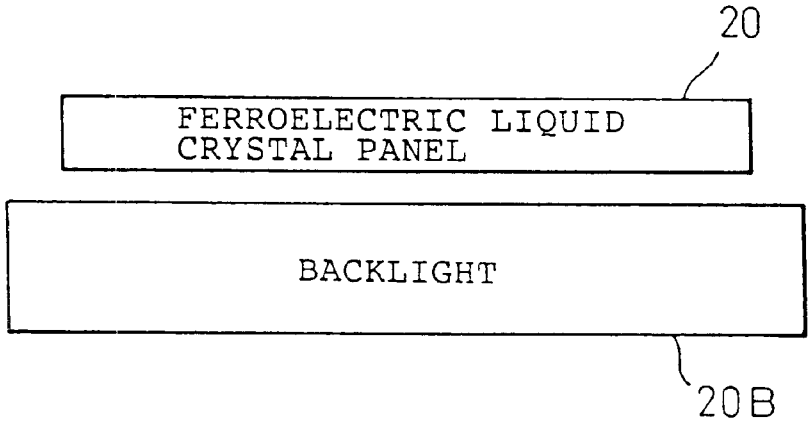
FIG. 4 is a diagram showing a configuration of a ferroelectric liquid crystal display having a backlight.

In the case where the driving waveforms described above are used, white display (transmission state) as well as black display (non-transmission state) are carried out during the reset period (Rs). The trailing phenomenon can be effectively reduced, however, by setting the entire reset period for black display. For this reason, the backlight is turned off during the reset period by using the ferroelectric liquid crystal display having a configuration including a ferroelectric liquid crystal panel 20 with a backlight 20B as shown in FIG. 4. During the reset period, the ferroelectric liquid crystal is in the first and second ferroelectric states as shown in FIG. 3, and therefore is in the transmission state during the first half of the reset period. If the backlight is turned off during the reset period as described above, however, the entire display during the reset period is recognized as black display by the human eyes, thereby reducing the trailing phenomenon.

Lengthening the black display period by lengthening the reset period, however, reduces the brightness of the whole display in spite of a reduced trailing phenomenon. As a result, a satisfactory display quality cannot be obtained. In view of this, according to this invention, the length of the reset period is adjusted in accordance with the image to be displayed while, at the same time, adjusting the brightness of the backlight turned on during the period other than the reset period in accordance with the length of the reset period. In the case where the reset period is long, for example, the turn-off period of the backlight lengthens and the whole display is darkened. Therefore, the brightness of the backlight is set to a high level. In the case where the reset period is short, on the other hand, the brightness of the backlight is not set to a high level or set to a low level. By adjusting the brightness of the backlight in this way, the brightness of the screen is prevented from changing extremely with the change, if any, in the length of the reset period, and therefore an optimum display quality can always be secured.

Embodiment 1

Figure 5:
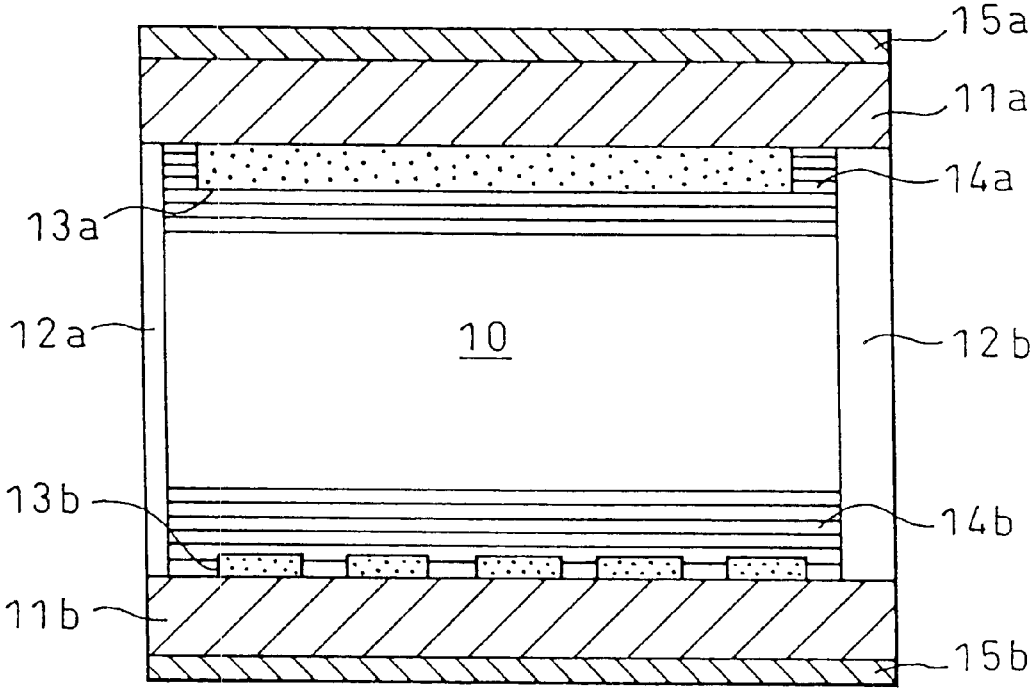
FIG. 5 is a diagram showing a configuration of a ferroelectric liquid crystal panel used in the invention.

An embodiment of the invention will be described in detail below with reference to the drawings. FIG. 5 is a diagram showing a panel configuration of a ferroelectric liquid crystal panel according to this embodiment. The liquid crystal panel used in this embodiment is configured with a pair of glass substrates 11*a,* 11*b* having a ferroelectric liquid crystal layer 10 about 1.7 $\mu$m thick. The opposed surfaces of the glass substrates are formed with a scanning electrode 13*a* and signal electrodes 13*b,* respectively, on which polymer alignment films 14*a,* 14*b* are coated and processed by rubbing. Further, on the outside surface of one glass substrate, a first polarization plate 15*a* is arranged in such a manner that the polarization axis thereof is parallel to the direction along the long axis of the ferroelectric liquid crystal molecules in the second ferroelectric state when no voltage is applied thereto. On the outside of the other glass substrate, on the other hand, a second polarization plate 15*b* is arranged with its polarization axis oriented at 90° to the polarization axis of the first polarization plate 15*a*.

Figure 6:
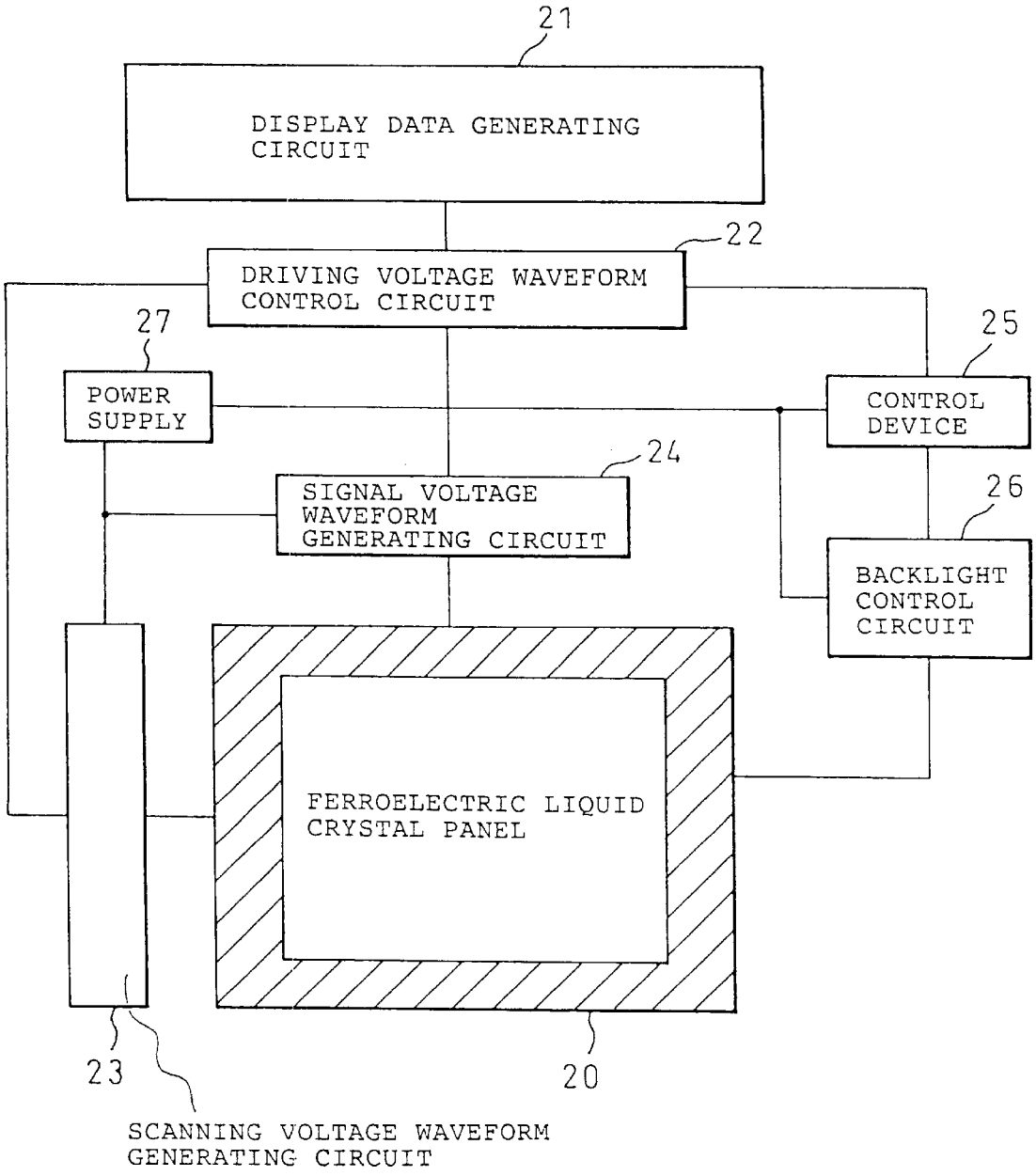
FIG. 6 is a block diagram showing a circuit configuration of a ferroelectric liquid crystal display according to the invention.

FIG. 6 is a block diagram showing a circuit configuration of a ferroelectric liquid crystal display according to this invention. The ferroelectric liquid crystal display according to this invention comprises a ferroelectric liquid crystal panel 20, a display data generating circuit 21, a driving voltage waveform control circuit 22, a scanning voltage waveform generating circuit 23, a signal voltage waveform generating circuit 24, a reset period adjusting control device 25, a backlight control circuit 26 and a power circuit 27. The reset period adjusting control device 25 adjusts the length of the reset period and, further, the backlight control circuit 26 changes the brightness of the backlight according to the length of the reset period.

FIG. 3 shows the conventional driving waveforms of the ferroelectric liquid crystal display which can be used in the present invention.

The driving waveforms according to this invention have at least one scanning period for carrying out the display based on one display data. In FIG. 3, each frame has one scanning period, but a plurality of scanning periods may be included in one frame.

As explained above with reference to FIG. 3, the scanning period has a selection period (Se) for selecting the display state according to the display data of the pixels, a non-selection period (NSe) for holding the selected state and a reset period (Rs) before starting the selection period (Se).

The reset period (Rs) is configured with 6 phases, in which the scanning voltage waveform (a) is set to 20 V during the three phases of the first half and to −20 V during the three phases of the last half. In the final pulse of the reset period, black is always displayed as the second ferroelectric state regardless of the immediately preceding display data. A voltage of 0 V is applied in the first phase, a voltage of −20 V in the second phase and a voltage of 20 V in the third phase of the selection period (Se) of the scanning voltage waveform (a), while the applied voltage during the non-selection period (NSe) is 0 V. Also, the signal voltage waveform (b) is set to a voltage of ±5 V. The width of each pulse is set to about 35 $\mu$s. The voltage actually applied to the pixels is a combined voltage waveform (c) of this scanning voltage waveform and the signal voltage waveform, and the state of the ferroelectric liquid crystal molecules is determined in each pixel.

In the case where the display data is ON (white display), the third phase of the selection period (Se) of the combined voltage waveform (c) exceeds the positive threshold value of the ferroelectric liquid crystal and the liquid crystal becomes the first ferroelectric state. During the non-selection period (NSe), this state is held and white is displayed. In the case where the display data is OFF (black display), on the other hand, black is always displayed during the reset period (Rs) regardless of the previous display state. During the selection period, therefore, a combined voltage lower than the threshold voltage is applied to hold the black display of the reset period.

According to this invention, in the case where display is based on the display data which is immediately changed in the next display, i.e. in the case where an animation having a rapid motion such as a game is displayed, the person observing the image on display can lengthen the reset period using the reset period adjusting control device 25 shown in FIG. 6 while watching the state of the image on display. For example, the reset period is lengthened by increasing the number of phases of the reset period. On the other hand, in the case where the display data remains unchanged as in a still image, i.e. in the case where the display is slow in motion, the reset period is shortened. By doing so, the trailing phenomenon is eliminated by displaying black during the last half of the reset period while changing the length of black display in accordance with the change amount of the display data regardless of the animation with the display successively changing based on the display data or the still image with the display remaining substantially unchanged.

Figure 7:
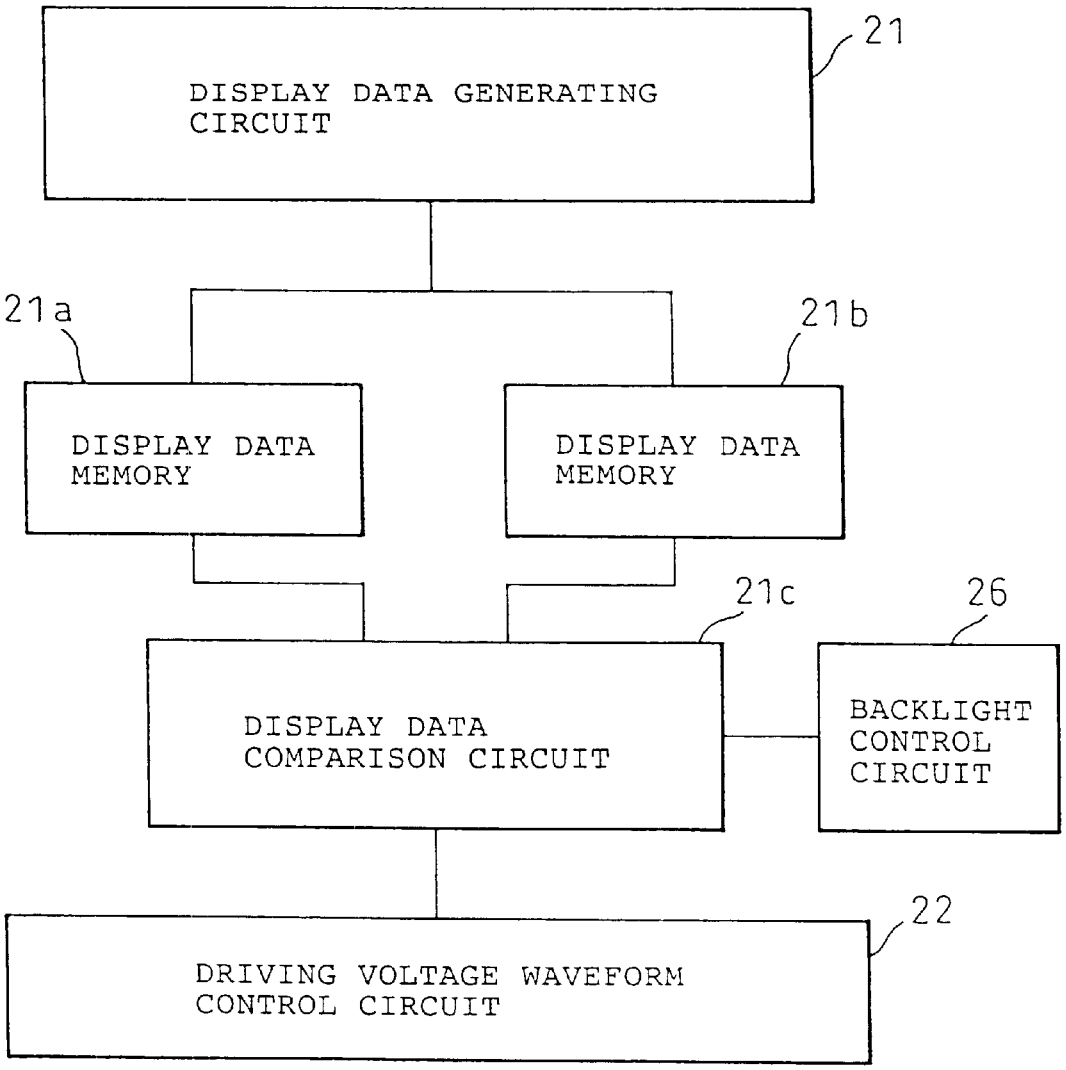
FIG. 7 is a block diagram showing a circuit configuration for adjusting the length of a reset period automatically.

Further, the length of black display can be adjusted by adjusting the length of the reset period automatically. FIG. 7 is a block diagram showing a circuit configuration for adjusting the length of the reset period automatically. This circuit configuration includes display data memories 21*a*, 21*b* for storing the display data from the display data generating circuit 21 of FIG. 6 and a display data comparison circuit 21*c* for comparing the display data of the display data memories and outputting the result to the driving voltage waveform control circuit 22 of FIG. 6. In this circuit configuration, the display data of the successive screens from the display data generating circuit 21 are stored in the display data memories 21*a*, 21*b*, and the two stored display data are compared in the display data comparison circuit 21*c*. In the case where the change rate of the data thus compared is large, it is determined that an image having a rapid motion is on display. In the case where the change rate of the data compared is small or zero, on the other hand, it is determined that an image having a slow motion or a still image is on display, and the result is input to the driving voltage waveform control circuit 22. In the case where the change rate of the data compared is large, the reset period is automatically lengthened. In the case where the change rate is zero or substantially nil, on the other hand, the reset period is shortened automatically. Also in this case, the brightness of the backlight is changed by the backlight control circuit 26 in accordance with the length of the reset period. Incidentally, the backlight control circuit 26 changes the brightness of the backlight in accordance with the output of the display data comparison circuit 21*c*.

Figure 8:
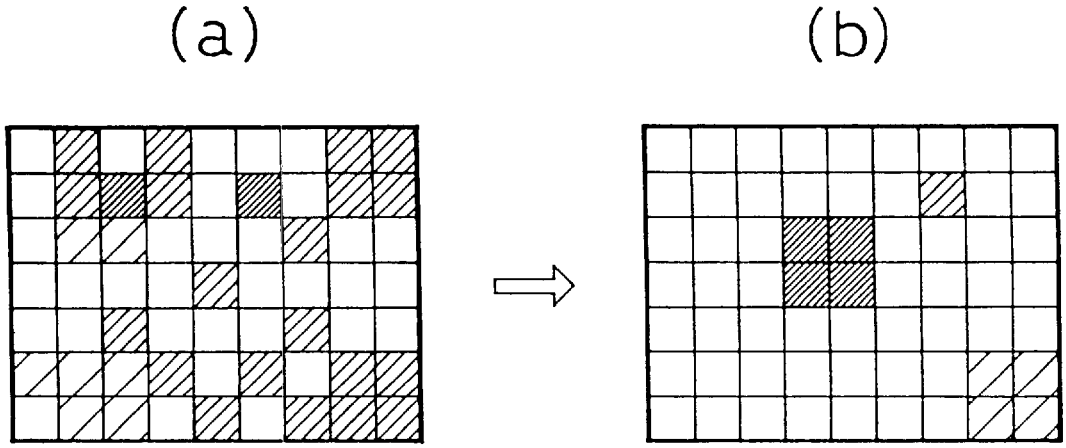
FIG. 8 is a diagram showing an example of a screen stored in a display data memory.

FIG. 8 is a diagram showing an example of screens stored in the display data memories 21*a*, 21*b*. These display data memories have stored therein the total value of the digitized brightness of the pixels of the screen. The numerical value of brightness is set to 1 for black and 256 for white, for example. The screens (a), (b) in FIG. 7 are successive screens, for example, The display data comparison circuit 21*c* of FIG. 7 compares the total value of the brightness of the screens (a) and (b), and in accordance with the change rate of the data, the driving voltage waveform control circuit adjusts the reset period automatically. In the case of the screens (a) and (b) shown in FIG. 8, the screen (b) has a large white display portion, and therefore the total value of brightness of the screen (b) is larger than that of the screen (a).

Either successive display data may be stored, or at intervals of a plurality of data, such as every other display data or every two other display data, the display data may be stored sequentially in the display data memories 21*a*, 21*b*. Also, three or more display data memories may be used instead of two as in this embodiment.

By providing display data memories and operating them in interlocked relation with the mechanism for adjusting the length of the reset period automatically in this way, the length of the reset period can be automatically adjusted even in the case where the ferroelectric liquid crystal display is incorporated in as a part of a large-sized apparatus. As a result, it is possible to obtain a liquid crystal display which requires little maintenance and can maintain a superior display state automatically.

Figure 9:
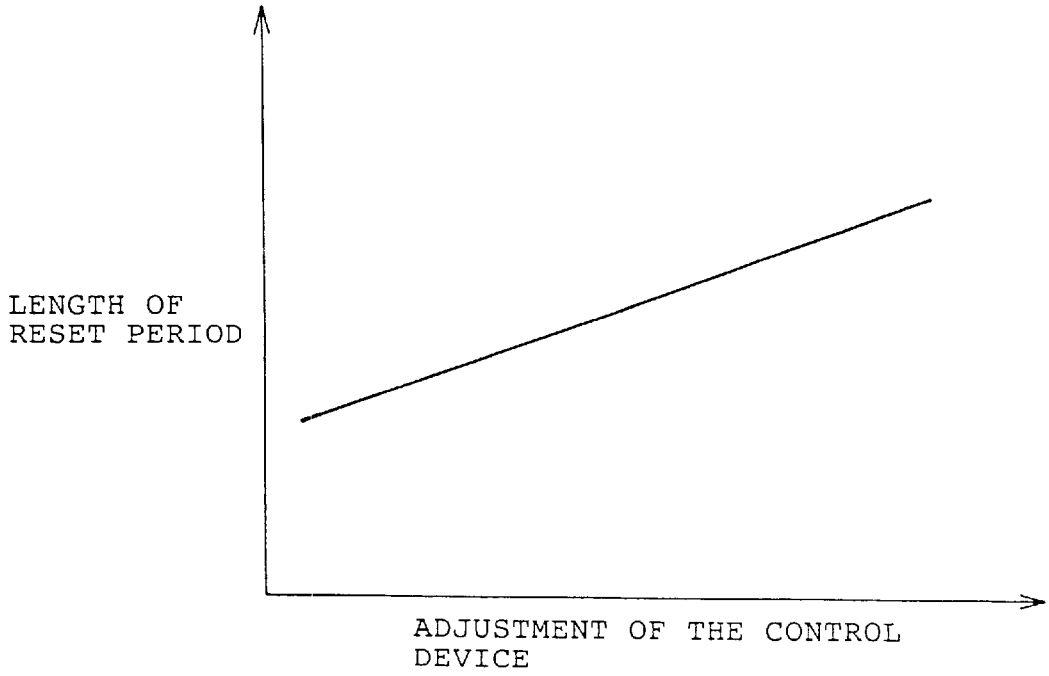
FIG. 9 is a graph showing the relation between the amount of a reset period adjusting volume control and the length of the reset period.

FIG. 9 is a graph showing the relationship between the adjustment of the control device and the length of the reset period. As shown, the reset period is lengthened by increasing the adjustment of the control device.

Figure 10:
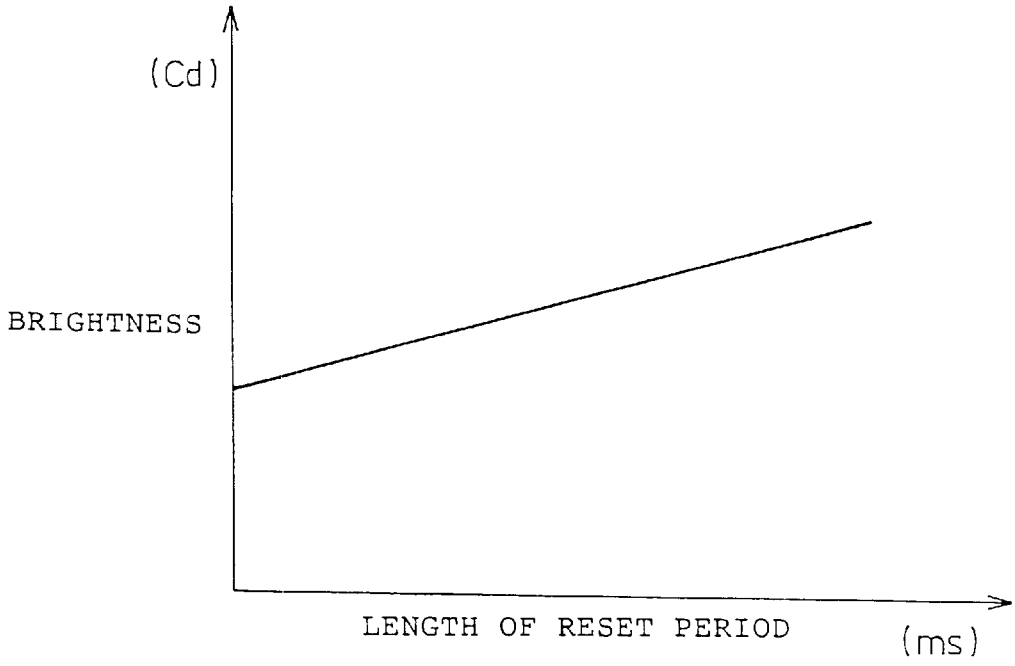
FIG. 10 is a graph showing the relation between the length of the reset period and the brightness of the backlight.

FIG. 10 is a graph showing the relationship between the length of the reset period and the brightness of the backlight. As shown, in the case where the reset period is long, the brightness of the backlight turned on during the period other than the reset period is increased, and the brightness is decreased in the case where the reset period is short. This adjustment is carried out by the reset period adjusting control device 25 and the backlight control circuit 26 shown in FIG. 6. By making adjustment in this way, a sufficiently bright liquid crystal display with a superior display quality was obtained even when the reset period is lengthened.

Embodiment 2

Figure 1:
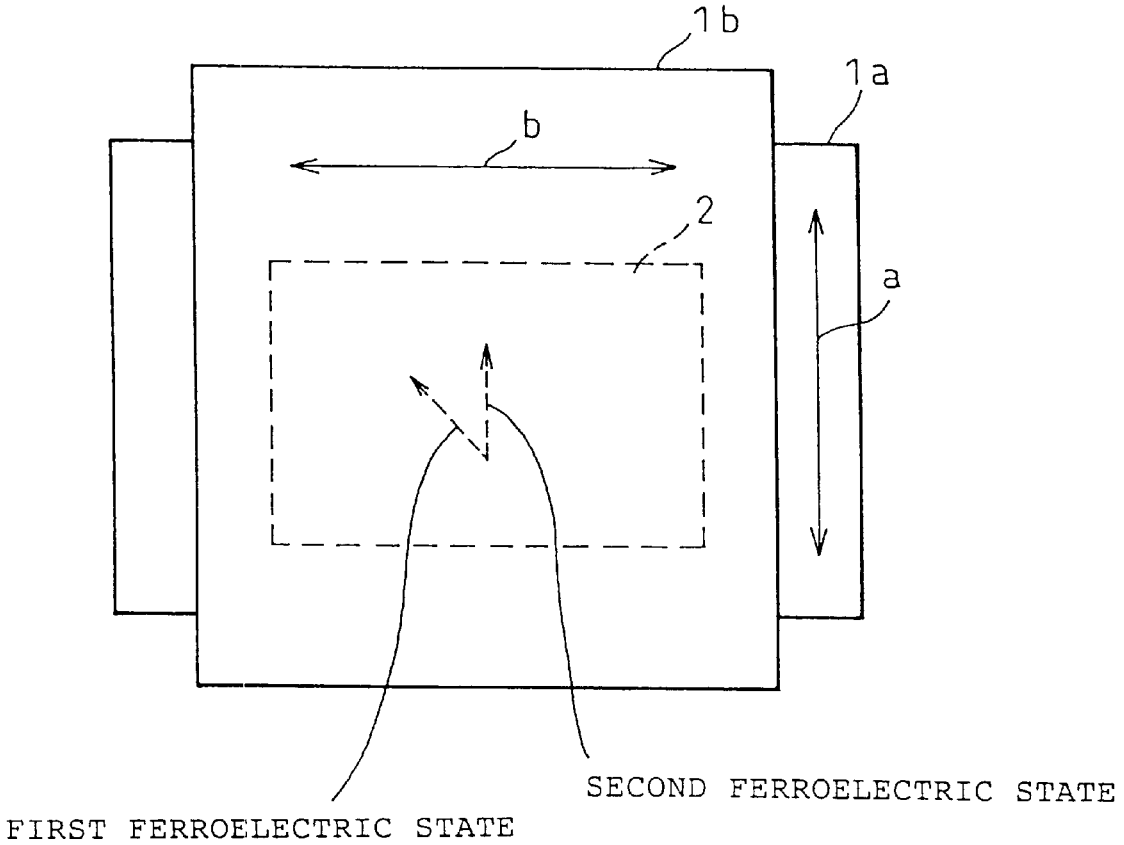
FIG. 1 is a diagram showing an example of a configuration of a ferroelectric liquid crystal panel using a ferroelectric liquid crystal as a display.
Figure 2:
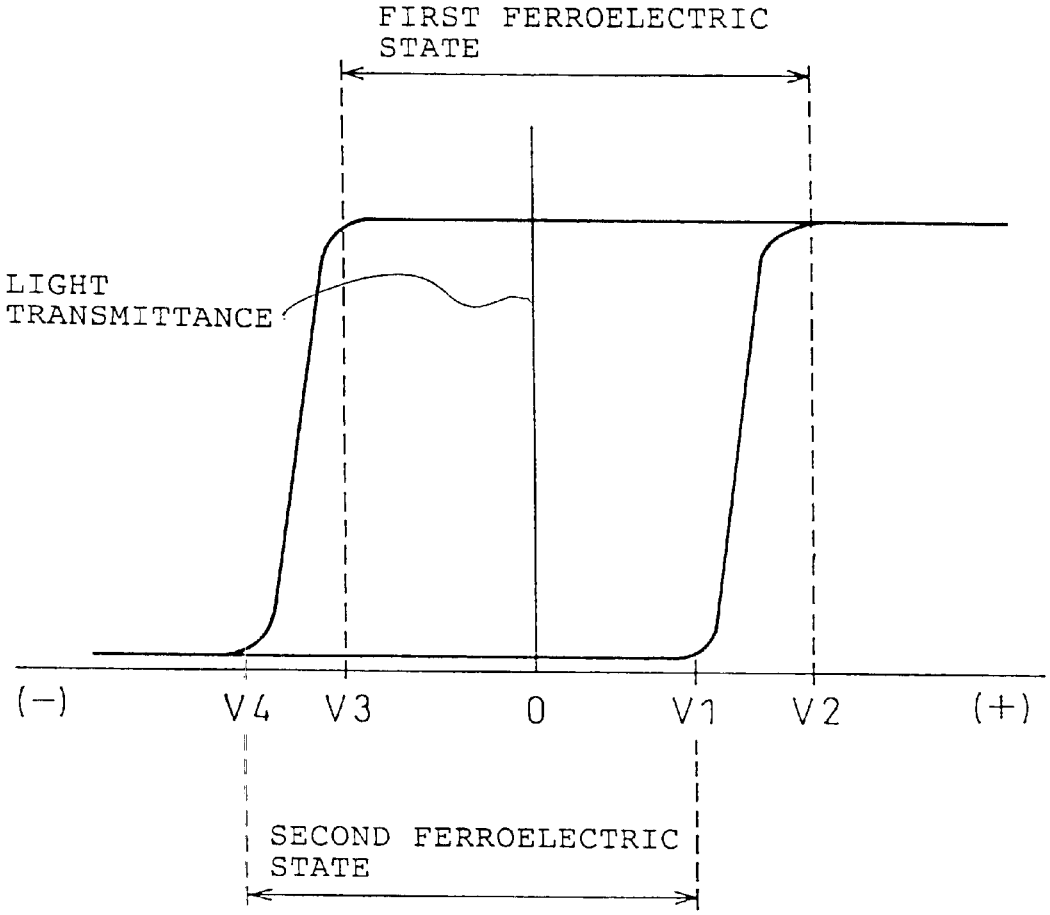
FIG. 2 is a graph showing the change in light transmittance versus the voltage applied to the ferroelectric liquid crystal panel.

Another embodiment of the invention will be described in detail with reference to the drawings. This embodiment, like the first embodiment, uses the circuit configuration shown in FIG. 6 and the panel configuration shown in FIG. 5. The polarization plate is also arranged as shown in FIG. 1, as in the first embodiment, and as shown in FIG. 2, set in transmission state when the liquid crystal is in the first ferroelectric state, and in non-transmission state when the liquid crystal is in the second ferroelectric state. Also according to this embodiment, as shown in FIG. 4, a backlight 20B is arranged under a liquid crystal display 20.

Figure 11:
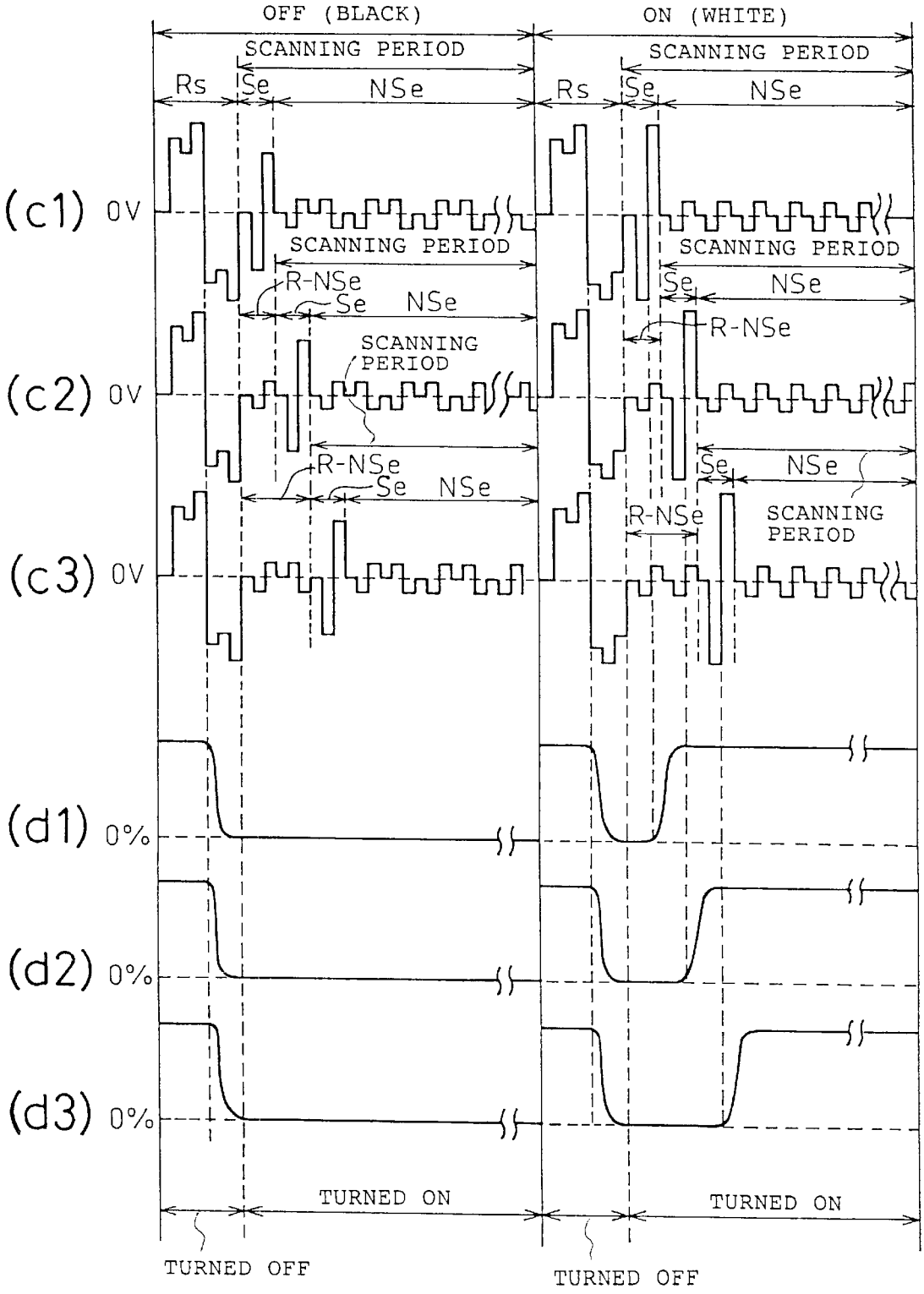
FIG. 11 is a diagram showing driving waveforms of a ferroelectric liquid crystal display according to the invention.

In the second embodiment, as in the first embodiment, the ferroelectric liquid crystal is set in both the first and second ferroelectric states during the reset period. According to the first embodiment, the reset period is provided for each pixel (i.e. for each scanning line), and therefore is displaced slightly for each scanning line. In the second embodiment, on the other hand, the reset period is provided to reset all the pixels at the same time. FIG. 11 is a diagram showing driving waveforms used in this embodiment. The diagram shows the driving waveforms and the light transmittance thereof in the case where the display data is ON (white display) and it is OFF (black display). c1, c2, c3 each designate a combined voltage waveform applied to each pixel, and d1, d2, d3 the transmittance of each pixel in the case where the combined voltage waveforms c1, c2, c3 are applied, respectively.

Each combined voltage waveform has at least one scanning period in order to carry out the display based on one display data. In FIG. 11, each frame has one scanning period. Instead, a plurality of scanning periods may be included in one frame. Each scanning period has therein a selection period (se) for selecting a display state based on the display data and a non-selection period (NSe) for holding the selected display state. Also, a reset period (Rs) is provided for setting all the pixels to the first ferroelectric state and the second ferroelectric state at the same time before starting the selection period (Se). The second embodiment is different from the first embodiment in that all the pixels are reset at the same time. As a result, a scanning line for which the scanning voltage is applied later has a non-selection period (R-NSe) for holding a reset state after the reset period (Rs). Thus, the period during which the reset state is maintained is lengthened. In the case of the driving waveforms shown in FIG. 11, for example, the period of the second ferroelectric state (non-transmission) is longer for pixel c3 than for pixel c1.

In the scanning voltage waveform (the same as the waveform of FIG. 3(*a*)) applied to c1, pulses of 6 phases are applied during the reset period immediately before starting the selection period, of which +20 V is applied during the three phases of the first half and a voltage of −20 V is applied during the three phases of the last half. Pulses of three phases are applied during the selection period of the scanning voltage waveform, of which a voltage of 0 V is applied during the first phase, a voltage of −20 V during the second phase and a voltage of +20 V during the third phase. Also, the applied voltage during the non-selection period is set to 0 V. Further, a voltage of ±5 V is applied as a voltage waveform on signal side. The width of each pulse is set to about 35 $\mu$s.

C1 to C3 of FIG. 11 show a waveform of a combined voltage of the voltage on the scanning side and the voltage on the signal side but not the voltage waveform on the scanning side.

The ferroelectric liquid crystal finally reaches the second ferroelectric state during the reset period (Rs), and displays black at the end of the reset period. In the case where the display data is ON (white display), like in the driving method shown in FIG. 3, the third phase of the selection period of the combined voltage waveform exceeds the positive threshold value of the ferroelectric liquid crystal so that the liquid crystal reaches the first ferroelectric state, while this state is held for white display during the non-selection period. In the case where the display data is OFF (black display), on the other hand, black is always displayed during the reset period, and therefore a combined voltage of less than the threshold value is applied during the selection period thereby the black display is held during the reset period.

The turn-on state of the backlight corresponding to each combined voltage waveform is shown in FIG. 11. Regardless of the previous display state, the liquid crystal is always set to the first ferroelectric state for transmission and the second ferroelectric state for non-transmission during the reset period. In the process, the backlight is turned off in synchronism with the reset period. Thus, although the reset period has a period during which the liquid crystal is in a transmission state, the display is recognized as black in the entire reset period and the trailing phenomenon is reduced during the entire reset period. Also, the driving waveforms shown in FIG. 11 has a non-selection period (R-NSe) for holding the reset state. Since this period is varied with the pixel position, the turn-off period is varied from one pixel to another. According to this embodiment, as shown in c1 of FIG. 11, the turn-off period is set to the length of the reset period for the pixel having the shortest reset period (the period of Rs alone).

According to this embodiment, as in the first embodiment, the length of the reset period can be adjusted by the reset period adjusting volume control 25 while watching the state of the image on display. As a result, the trailing phenomenon is caused in neither the animation with the display successively changing based on the display data nor the still image with the display not substantially changed. Further, this embodiment, like the first embodiment, includes a display data memory operating in interlocked relation with the mechanism for adjusting the length of the reset period, thereby making it possible to change the length of the reset period automatically.

Also, as in the first embodiment, the reset period adjusting volume control 25 and the backlight control circuit 26 are so set as to increase the brightness of the backlight with the increase in the length of the reset period and decrease the brightness with the decrease in the length of the reset period. Further, in the case where the length of the reset period is automatically changed, the backlight control circuit 26 changes the brightness of the backlight in accordance with the output of the display data comparison circuit 21*c*. By making this adjustment, a sufficiently bright, superior display quality was obtained even for a long reset period of black display.

By the way, this embodiment, as shown in FIG. 11, has a non-selection period (R-NSe) for holding the reset state in the scanning period, and as indicated in the driving waveforms c1, c2, c3 and this period becomes longer progressively as the pixel changes to a lower position in the drawing, so that the turn-off period gradually becomes longer. In other words, the lower the pixel position, the longer the black display period, resulting in a darker screen. For solving this inconvenience, the brightness of the backlight can be adjusted in accordance with the pixel position, or the order in which the screen is scanned is changed for each screen, e.g. top down or bottom up.

What is claimed is:

1. A ferroelectric liquid crystal display having a ferroelectric liquid crystal panel holding a ferroelectric liquid crystal between a pair of substrates, means for generating display data for said liquid crystal display, wherein at least one scanning period is provided when carrying out the display based on one display data, and a reset period for resetting the ferroelectric liquid crystal to black display state is provided before the start of the scanning period, and a mechanism for adjusting the length of the black display state (non-transmission state) in the reset period in accordance with the display data.

2. A ferroelectric liquid crystal display as set forth in claim 1, wherein the liquid crystal panel includes pixels and the reset period is provided for each pixel.

3. A ferroelectric liquid crystal display as set forth in claim 1, wherein the liquid crystal panel includes pixels and the reset period is provided in such a manner as to reset all the pixels at the same time.

4. A ferroelectric liquid crystal display as set forth in claim 1, wherein the ferroelectric liquid crystal panel includes a backlight, said backlight being turned off during the reset period and turned on during the remaining period.

5. A ferroelectric liquid crystal display as set forth in claim 1, wherein the ferroelectric liquid crystal panel includes a backlight, and further providing a mechanism for adjusting the brightness of the backlight in which the brightness of the backlight is set to a high level in the case where the reset period is long and the brightness of the backlight is not set to a high level or set to a low level in the case where the reset period is short.

6. A ferroelectric liquid crystal display as set forth in claim 1, wherein the ferroelectric liquid crystal has a first ferroelectric state and a second ferroelectric state during the reset period, and the scanning period has a selection period (Se) for selecting the display state and a non-selection period (NSe) for holding the selected display state.

7. A ferroelectric liquid crystal display as set forth in claim 1, wherein the mechanism for adjusting the length of said black display state in the reset period is a reset period adjusting control device.

8. A ferroelectric liquid crystal display having a ferroelectric liquid crystal panel holding a ferroelectric liquid crystal between a pair of substrates and means for generating display data for said liquid crystal display, and wherein at least one scanning period is provided when carrying out the display based on one display data, and a reset period for resetting the ferroelectric liquid crystal to black display state is provided before the start of the scanning period, said display further having a mechanism for adjusting the length of the reset period in accordance with the display data, the mechanism including a plurality of display data memories for continuously storing the display data or sequentially storing the display data at intervals of a plurality of blocks thereof, and a display data comparison circuit for comparing the display data of the display data memories and outputting the result of comparison, the reset period being automatically adjusted in accordance with the output.

* * * * *